US005921193A

United States Patent [19]

Chou

[11] Patent Number: 5,921,193

[45] Date of Patent: Jul. 13, 1999

[54] FABRIC CLIPPING GUIDE FOR AN OVERLOCK MACHINE

[76] Inventor: Su-Lin Chou, No. 450, Ching Ping Road, Chung Ho City, Taipei Hsien, Taiwan

[21] Appl. No.: 09/033,594

[22] Filed: Mar. 3, 1998

[51] Int. Cl.[6] ..... D05B 65/06

[52] U.S. Cl. ..... 112/282; 112/287; 112/DIG. 1

[58] Field of Search ..... 112/287, 470.36, 112/282, DIG. 1–DIG. 3; 83/99, 100, 905, 910

[56] References Cited

U.S. PATENT DOCUMENTS

| | | | |
|---|---|---|---|
| 3,143,987 | 8/1964 | Daniel et al. | 112/287 |
| 3,853,079 | 12/1974 | Dunne | 112/DIG. 1 |
| 4,328,758 | 5/1982 | Souza et al. | 112/287 |
| 4,709,645 | 12/1987 | Jones et al. | 112/287 |
| 4,764,058 | 8/1988 | Jones et al. | 112/DIG. 1 |
| 5,345,888 | 9/1994 | Frankel | 112/DIG. 3 |
| 5,613,454 | 3/1997 | Adamski, Jr. et al. | 112/287 |
| 5,657,709 | 8/1997 | Miyachi et al. | 112/287 |

*Primary Examiner*—Ismael Izaguirre

*Attorney, Agent, or Firm*—Bacon & Thomas, PLLC

[57] ABSTRACT

A fabric clipping guide installed in an overlock machine for guiding fabric clippings to a fabric clipping collector, the fabric clipping guide including a hopper for receiving fabric clippings from the overlock machine, the hopper having a sloping bottom guide tube, the guide tube having a bigger first guide hole connected to the fabric clipping collector and a smaller second guide hole reversed to the first hole, a nozzle having an outlet at one end connected to the second guide hole on the guide tube of the hopper, a suction hole at an opposite end, a threaded collar on the middle, a neck between the collar and the suction hole, a plurality of oblique through holes spaced around the neck and extended from one side of the, threaded collar to the inside of the nozzle, a socket threaded onto the threaded collar and defining an annular air chamber, a connector mounted on the socket for guiding high pressure air into the air chamber and the inside of the nozzle through the oblique through holes on the threaded collar, permitting high pressure air to be turned round and round and forced out of the outlet of the nozzle through the second guide hole and the first guide hole on the guide tube of the hopper to carry fabric clippings from the hopper to the fabric clipping collector.

6 Claims, 4 Drawing Sheets

FABRIC CLIPPING GUIDE FOR AN OVERLOCK MACHINE

BACKGROUND OF THE INVENTION

The present invention relates to a fabric clipping guide for installation in an overlock machine for guiding fabric clippings from the stitching mechanism of the overlock machine to a fabric clipping collector, and more particularly to such a fabric clipping guide which turns an intake flow of high pressure air into an eddy flow of high pressure air to effectively suck in thread tips and fabric clippings from the overlock machine and to rapidly carry thread tips and fabric clippings to the fabric clipping collector.

FIG. 4 shows a regular overlock machine. The overlock machine 90 comprises a stitching mechanism 91, a hopper 60 disposed in front of the stitching mechanism 91, a first guide tube 61 extended from the hopper 60 and connected to a fitting 70. The fitting 70 has a first inlet connected to the guide tube 61, an outlet connected to the fabric clipping collector 80, a second inlet connected to an air nozzle 71, and a third inlet connected to a second guide tube 62. The second guide tube 62 has an opposite end connected to a thread cutting end 92 of the stitching mechanism 91. Because the air nozzle 71 is disposed at the front ends of the guide tubes 61;62, it produces low suction force. Further, this arrangement occupies much table space of the overlock machine 90.

SUMMARY OF THE INVENTION

The present invention has been accomplished to provide a fabric clipping guide for an overlock machine which eliminates the aforesaid drawbacks. It is one object of the present invention to provide a fabric clipping guide for an overlock machine which requires less installation space. It is another object of the present invention to provide a fabric clipping guide which turns an intake flow of high pressure air into an eddy flow of high pressure air to effectively suck in thread tips and fabric clippings from the overlock machine and to rapidly carry thread tips and fabric clippings to the fabric clipping collector. To achieve these and other objects of the present invention, there is provided a fabric clipping guide installed in an overlock machine for guiding fabric clippings to a fabric clipping collector, the fabric clipping guide comprising a hopper for receiving fabric clippings from the overlock machine, the hopper having a sloping bottom guide tube, the guide tube having a bigger first guide hole connected to the fabric clipping collector and a smaller second guide hole reversed to the first hole, a nozzle having an outlet at one end connected to the second guide hole on the guide tube of the hopper, a suction hole at an opposite end, a threaded collar on the middle, a neck between the collar and the suction hole, a plurality of oblique passageways spaced around the neck and extended from one side of the threaded collar to the inside of the nozzle, a socket threaded onto the threaded collar and defining an annular air chamber, a connector mounted on the socket for guiding high pressure air into the air chamber and the inside of the nozzle through the oblique through holes on the threaded collar, permitting high pressure air to be turned round and round and forced out of the outlet of the nozzle throught the second guide hole and the first guide hole on the guide tube of the hopper to carry fabric clippings from the hopper to the fabric clipping collector.

DETAILED DESCRIPTION OF THE PREFERRED EMBODIMENT

Figure 1:
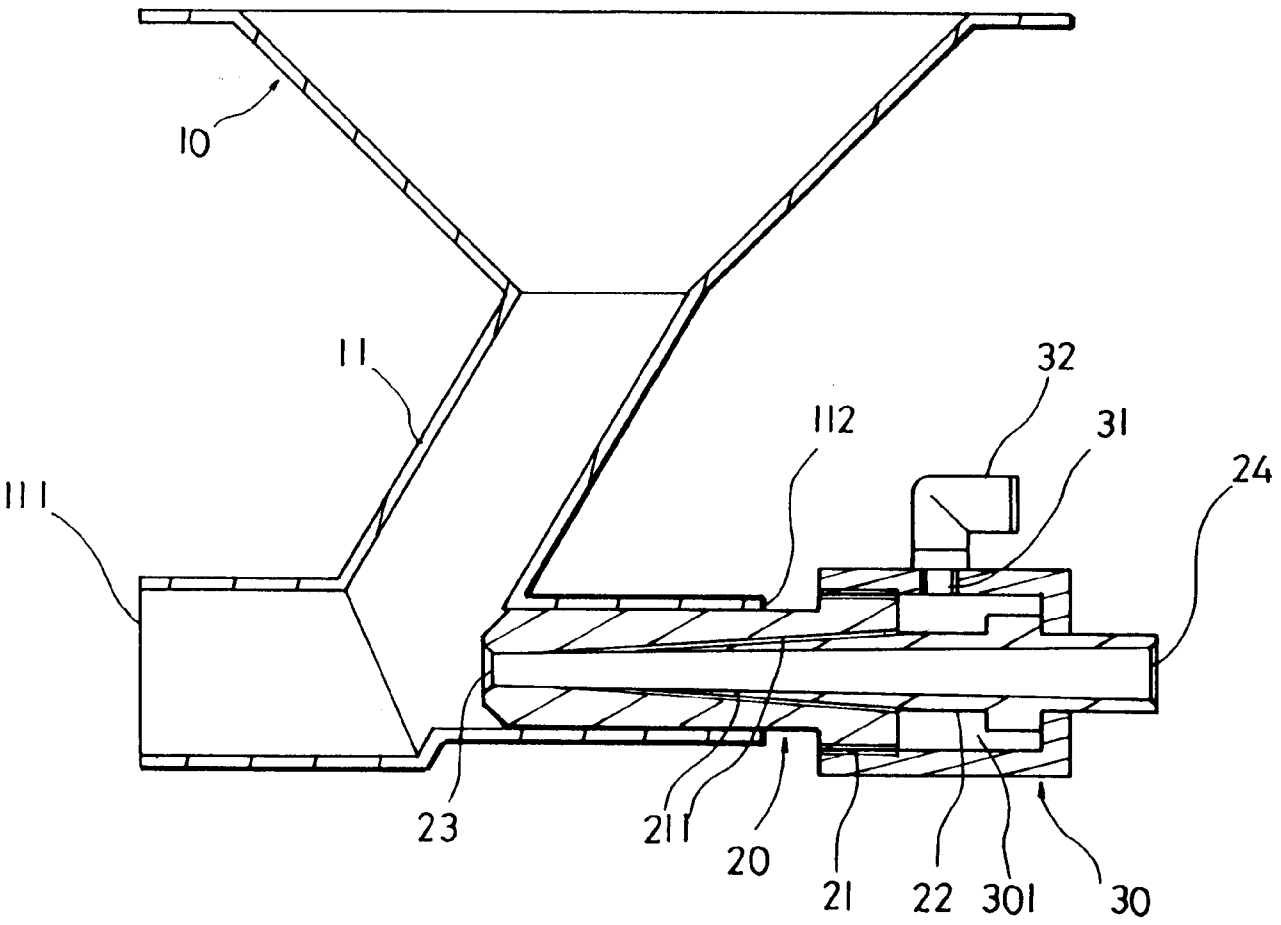
FIG. 1 is a sectional view of a fabric clipping guide according to the present invention.
Figure 2:
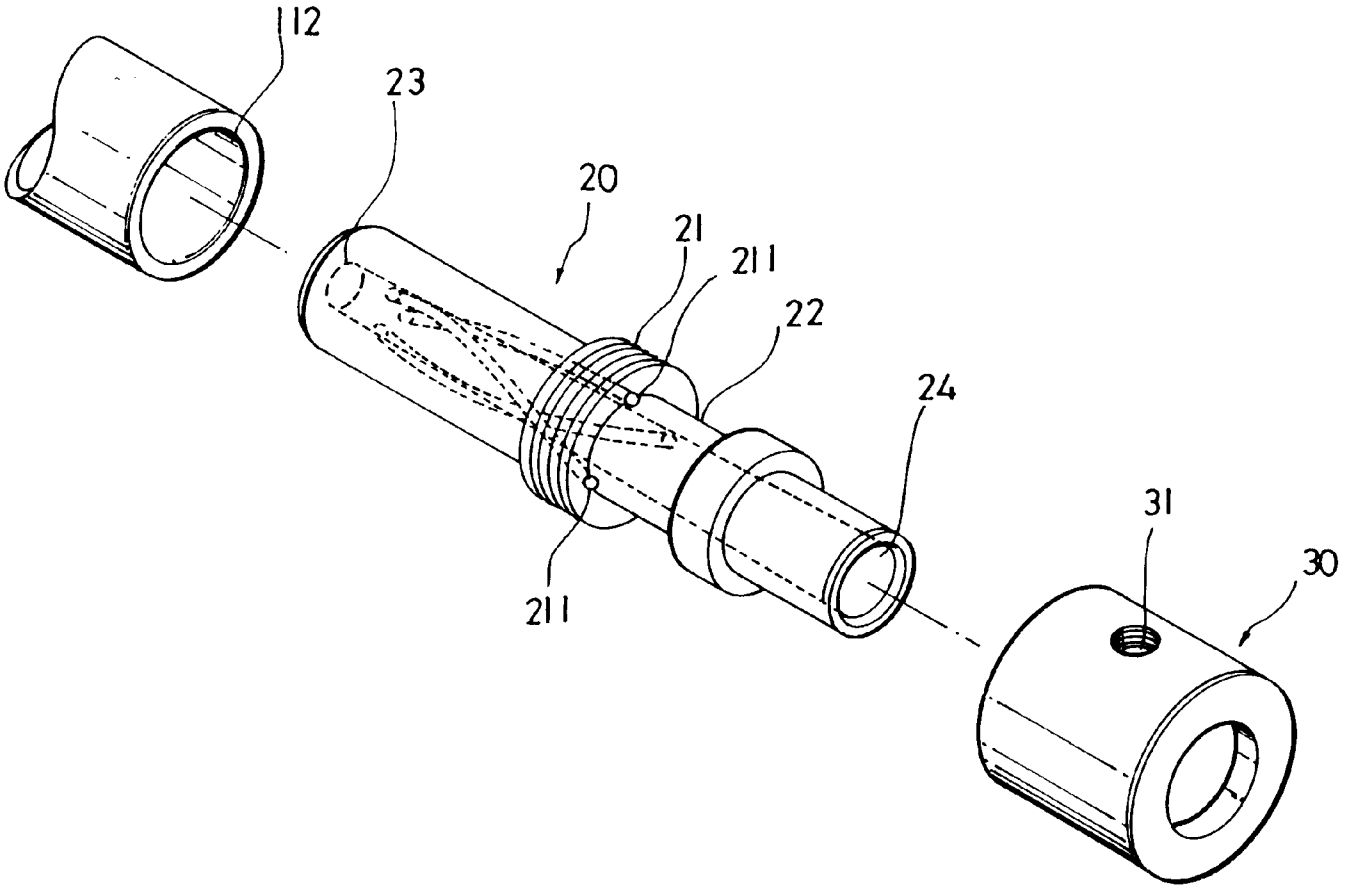
FIG. 2 is a perspective exploded view of a part of the present invention.

Referring to FIGS. 1 and 2, a fabric clipping guide in accordance with the present invention is installed in an overlock machine and used for guiding fabric clippings cut from stitched fabrics to a fabric clipping collector. The fabric clipping guide comprises a hopper 10, and a guide tube 11 obliquely extended from the hopper 10 at the bottom. The guide tube 11 has a first guide hole 111 and an oppositely facing second guide hole 112 at the bottom of tube 111. The inner diameter of the second guide hole 112 is slightly smaller than that of the first guide hole 111. A cylindrical nozzle 20 is coupled to the second hole 112 on the guide tube 11. The nozzle 20 has mounting means, for example a threaded collar 21 around the middle thereof, a neck 22 in front of the threaded collar 21, a plurality of oblique passageways 211 spaced around the neck 22 and extending from the threaded collar 21 at one side thereof to the inside of the nozzle 20, a tapered outlet 23 at one end, and a suction hole 24 at an opposite end. When compressed air is driven through the passageways 211 into the inside of the nozzle 20, it is forced out of the tapered outlet 23 into the second hole 112 on the guide tube 11. When passing through the tapered outlet 23, a flow of air is compressed and forced to turn round and round toward the second guide hole 112 on the guide tube 11. A socket 30 is threaded onto the threaded collar 21 on the nozzle 20, defining an annular air chamber 301 around the neck 22 of the nozzle 20. The socket 30 has a radial through hole 31 disposed in communication with the annular air chamber 301. Further, a connector 32 is mounted in the radial through hole 31.

Figure 3:
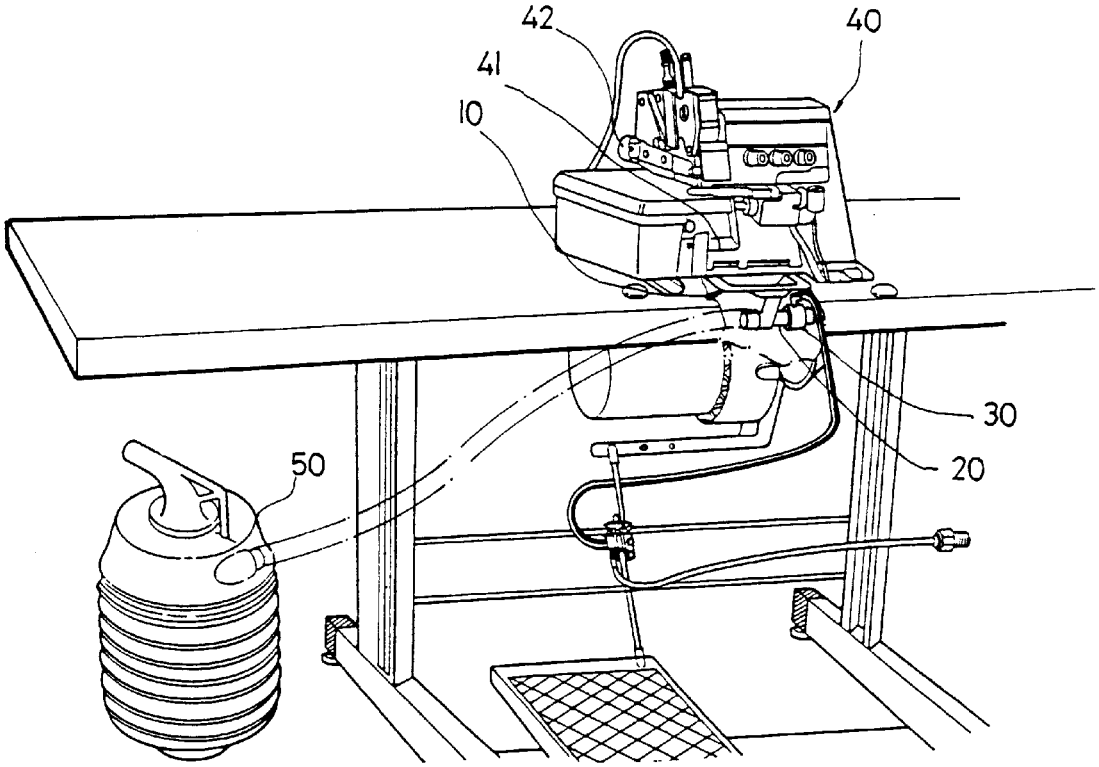
FIG. 3 is an applied view of the present invention, showing the fabric clipping guide installed in an overlock machine.
Figure 4:
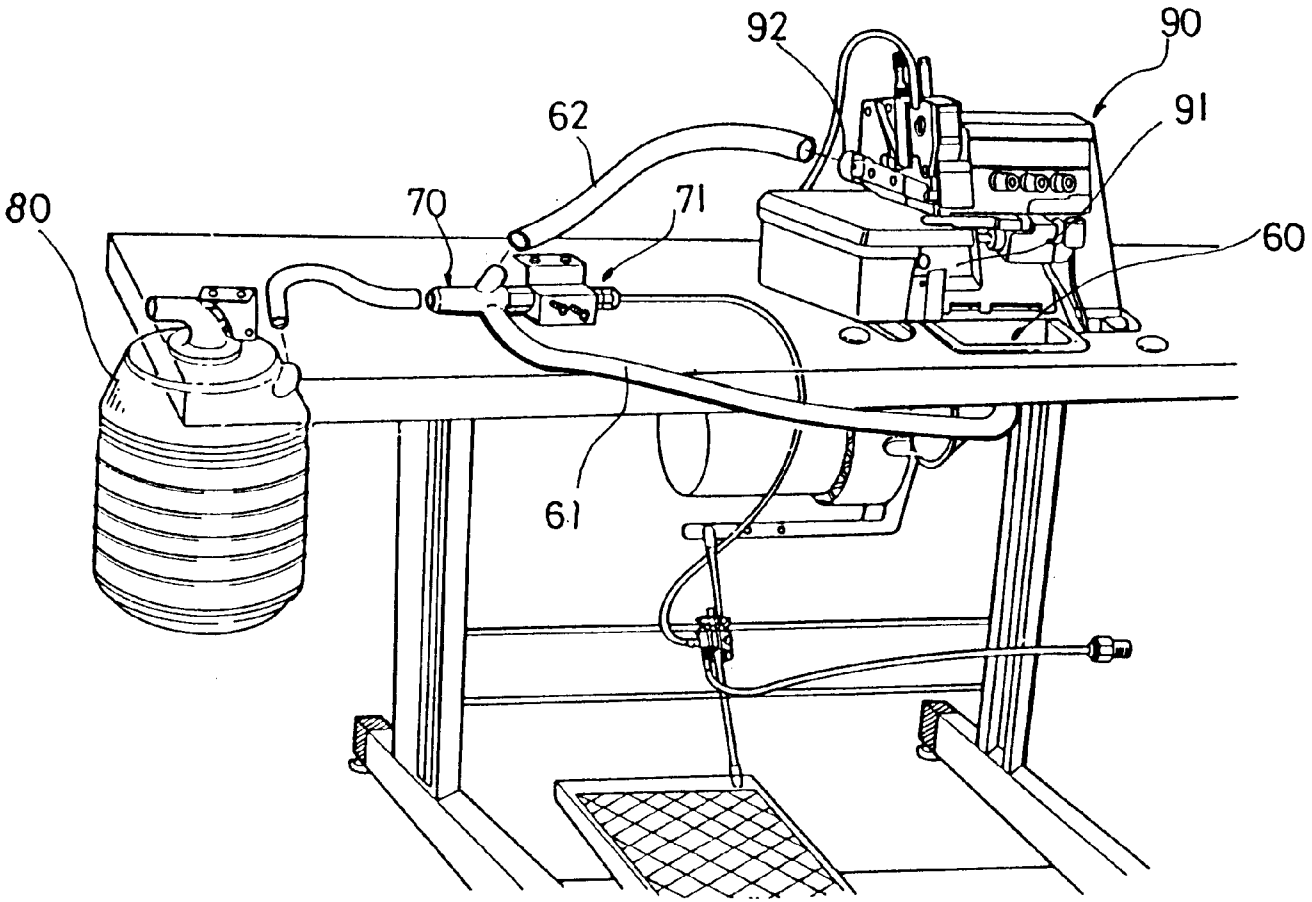
FIG 4 PRIOR ART
FIG. 4 shows an overlock machine equipped with a fabric clipping guide and collecting system according to the prior art.

Referring to FIG. 3 and FIGS. 1 and 2 again, the hopper 10 is fixedly mounted in an overlock machine 40 in front of the stitching mechanism 41 of the overlock machine 40, the first guide hole 111 of the guide tube 11 is connected to a fabric clipping collector 50, and the suction hole 24 of the nozzle 20 is connected to the thread cutting end 42 of the overlock machine 40. When high pressure air is guided through the connector 32 into the annular air chamber 301, it flows through the oblique passageways 211 into the second guide hole 112 on the hopper 10 via the tapered outlet 23. When passing through the tapered outlet 23, high pressure air is turned round and round and forms a spiral flow of high pressure air passing through the second guide hole 112 to the fabric clipping collector 50 through the first guide hole 111. When the spiral flow of high pressure air passes through the first guide hole 11 and the second guide hole 112, a suction force is produced to suck fabric clippings into the hopper 10 and carried with the spiral flow of high pressure air to the fabric clipping collector 50.

While only one embodiment of the present invention has been shown and described, it will be understood that various modifications and changes could be made thereunto without departing from the spirit and scope of the invention disclosed.

What the invention claims:

1. A fabric clipping guide installed in an overlock machine for guiding fabric clippings to a fabric clipping collector, the fabric clipping guide comprising:

a hopper for receiving fabric clippings from the overlock machine, said hopper having a downwardly extended guide tube, said guide tube having a bottom end terminating in a first guide hole and a second guide hole arranged in reversed direction, said first guide hole being connected to the fabric clipping collector;

a nozzle having an outlet at one end connected to the second guide hole on the guide tube of said hopper, a suction hole at an opposite end, and a connector mounted thereon for guiding high pressure air into said cylindrical nozzle, permitting high pressure air to be turned round and round and forced out of the outlet on said nozzle through the second guide hole and the first guide hole on the guide tube of said hopper to said fabric clipping collector, so that a vacuum suction force is produced in said hopper to suck in fabric clippings and to let fabric clippings be carried with high pressure air to said fabric clipping collector; and wherein said nozzle comprises a threaded collar on the middle outside the second guide hole of said guide tube of said hopper, a neck between said threaded collar and said suction hole, a plurality of passageways spaced around said neck for guiding high pressure air toward the second guide hole on the guide tube of said hopper through the outlet on said nozzle, and a socket threaded onto said threaded collar around said neck, said socket having a radial through hole which receives said connector.

2. The fabric clipping guide of claim 1, wherein said guide tube downwardly extends from said hopper in a sloping angle.

3. The fabric clipping guide of claim 1, wherein the diameter of the second guide hole of said guide tube of said hopper is smaller than that of the first guide hole of said guide tube of said hopper.

4. The fabric clipping guide of claim 1, wherein said socket defines annular air chamber around said neck for receiving high pressure air from said connector, permitting high pressure air to be guided through the passageways on said nozzle to the second guide hole on said guide tube of said hopper through the outlet on said nozzle.

5. The fabric clipping guide of claim 1, wherein the passageways on said nozzle are spaced around said neck and respectively and obliquely extend from said threaded collar at one side thereof to the inside of said nozzle for guiding high pressure air toward the second guide hole on the guide tube of said hopper through the outlet on said nozzle.

6. The fabric clipping guide of claim 1, wherein the outlet of said nozzle is a tapered hole having an inner diameter gradually reduced toward the second guide hole on said guide tube of said hopper.

* * * * *